United States Patent [19]

Beech

[11] Patent Number: 4,632,386

[45] Date of Patent: Dec. 30, 1986

[54] FOLDABLE EXERCISE CYCLE

[75] Inventor: Charles R. Beech, Lincolnton, N.C.

[73] Assignee: Allegheny International Exercise Co., Lincolnton, N.C.

[21] Appl. No.: 696,618

[22] Filed: Jan. 30, 1985

[51] Int. Cl.[4] ..... A63B 21/00

[52] U.S. Cl. ..... 272/73; 297/51; 248/649

[58] Field of Search ..... 272/73; 128/25 R, 71; D16/18, 24; 248/166, 649; 108/128; 269/901; 297/51, 54

[56] References Cited

U.S. PATENT DOCUMENTS

| | | | |
|---|---|---|---|
| D. 218,623 | 9/1970 | Margolies | D34/5 |
| D. 224,329 | 7/1972 | Hjelmquist | D34/5 |
| 391,247 | 10/1888 | Hayes et al. | 248/166 |
| 2,107,447 | 2/1938 | Marlowe | 272/73 |
| 3,057,201 | 10/1962 | Jaeger | 272/73 |
| 3,498,607 | 3/1970 | Eichholz | 272/73 |
| 3,578,800 | 5/1971 | Dinepl | 272/73 |
| 4,140,312 | 2/1979 | Buchmann | 272/73 |
| 4,212,480 | 7/1980 | Mikina et al. | 272/73 |

FOREIGN PATENT DOCUMENTS

| | | | |
|---|---|---|---|
| 119209 | 4/1970 | Norway | 272/73 |
| 2108000A | 5/1983 | United Kingdom . | |
| 2130901 | 6/1984 | United Kingdom | 272/73 |

*Primary Examiner*—Richard J. Apley
*Assistant Examiner*—S. R. Crow
*Attorney, Agent, or Firm*—John K. Williamson; John L. LaPierre

[57] ABSTRACT

A portable cycle-type exercising device capable of being quickly and easily erected for use and readily and compactly folded for convenient storage in a relatively small area during periods of nonuse. The cycle upright members and support legs are adaptable for folding or collapsing inwardly while the handlebar is adaptable for rotation about the cycle housing.

12 Claims, 7 Drawing Figures

FOLDABLE EXERCISE CYCLE

BACKGROUND OF THE INVENTION

The present invention relates to an exercising device and, more particularly, to a foldable, portable, cycle-type, exercising apparatus suitable for use indoors, as for example, in homes, businesses, gymnasiums, and the like. Specifically, the invention is directed to an exercise cycle adapted to be rapidly erected for use and quickly collapsed for storage. The foldable cycle is dependably rigid when erected for use and conveniently portable when compactly folded for storage.

There are a variety of exercise cycles available in the marketplace today. There can even be found cycles capable of being folded and transported. However, unlike the present inventive cycle, no cycle encountered is capable of being quickly and easily displayed for use while also capable of being readily collapsed into a compact form for convenient storage in a small space during periods of cycle nonuse. No known cycle-type exercising device utilizes sliding and pivoting legs in combination with a handlebar which folds about the cycle housing.

Typical, folding, cycle-type exercisers might best be exemplified in the patent to Margolies, U.S. Des. No. 218,623,and the U.K. patent application of Lew-Ways Limited, GB No. 2 108 000 A. These cycles, however, both employ a scissor type folding action, resulting in a cycle having an overall height which is greater when folded for storage than when deployed for use. Another foldable/collapsible, cycle-type exerciser can be found disclosed in the patent to DiNepl, U.S. Pat. No. 3,578,800, wherein the cycle folds scissor-like and additionally employs telescoping legs and moveable upright members. The DiNepl disclosure, while providing a cycle having a collapsed state of lesser overall height than its operating state, does not provide a cycle which pivotally receives collapsing legs nor does it provide a handlebar that folds about the cycle body when the cycle is in its storage position. Thus a feature embodied in the present cycle of having a cycle compactly folded for storage cannot be found in the teachings of DiNepl.

Additional foldable exercise cycles may be found in the patent to Buchmann, U.S. Pat. No. 4,140,312, and the patent to Eichholz, U.S. Pat. No. 3,498,607. Buchmann, like DiNepl, provides for cycle collapsing by virtue of telescoping members, does not contemplate a cycle having pivotally extending and retracting legs, and does not envision a handlebar folding about the cycle body when the cycle is in its storage position. The Eichholz cycle features disassembly of seat and handlebar structures and partial disassembly of leg support structure to achieve an exercise cycle in its collapsed storage or transport state.

The present inventive exercise cycle was developed to provide a cycle which is economical to manufacture and can easily be converted from a rigid, upright operating position to a compact, nonoperating storage position and redeployed for use with equal facility. The cycle requires no disassembly and its compact size in the folded, nonuse state provides a device which can be comfortably carried and conveniently stored in accessible but relatively small spaces such as under a desk, in a corner of a closet, and on a shelf, to name but a few storage locations.

SUMMARY OF THE INVENTION

The present invention relates to a foldable exercise cycle which may readily be converted from an erect operating position to a compact storage position. The cycle includes a frame having legs supporting a housing and a foot activated exercising device. Additionally included are height adjustable upright members which may be releasably anchored at a selected height. One upright member supports a seat, the other supports a handlebar, the handlebar being anchored upright during cycle use but may be loosened for rotation about the cycle housing during cycle nonuse. A substantial portion of the upright members and substantially all of the cycle legs may be urged into the cycle housing to place the cycle in the storage mode. The cycle might further exhibit means for enhancing leg retention during cycle use and for releasably securing the legs within the cycle housing during both the cycle operating and storage modes. A guide means might also be deployed to direct the movement of the cycle legs when extended for use and retracted for storage. Conversion of the cycle from use to nonuse position is readily accomplished by pushing the legs into the housing, lowering the upright members, and rotating the handlebar about the cycle housing.

The various features of novelty which characterize the invention are pointed out with particularity in the claims annexed to and forming a part of this disclosure. For a better understanding of the invention, its operating advantages and specific results obtained by its use, reference should be made to the accompanying drawings and descriptive matter in which there is illustrated and described a typical embodiment of the invention.

DETAILED DESCRIPTION OF THE PREFERRED EMBODIMENT

Figure 1:
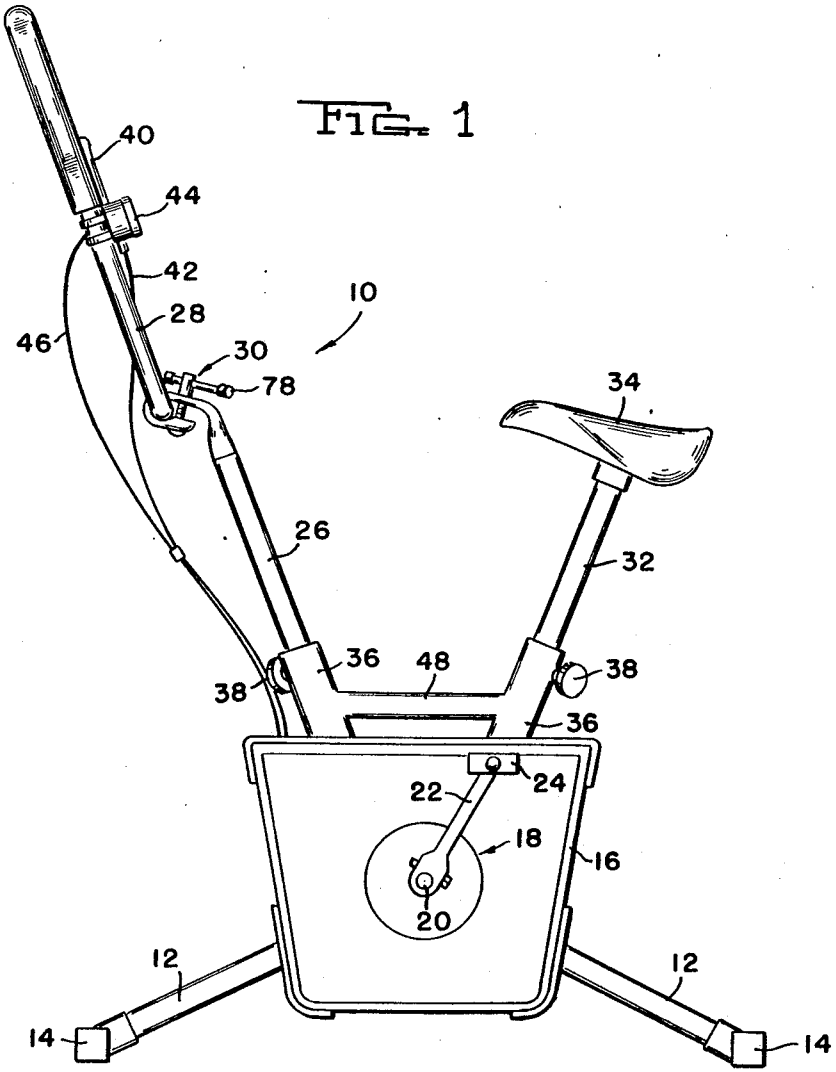
FIG. 1 is a left side elevational view of a foldable exercise cycle embodying the principles of the present invention wherein there is depicted the cycle in position for use.
Figure 2:
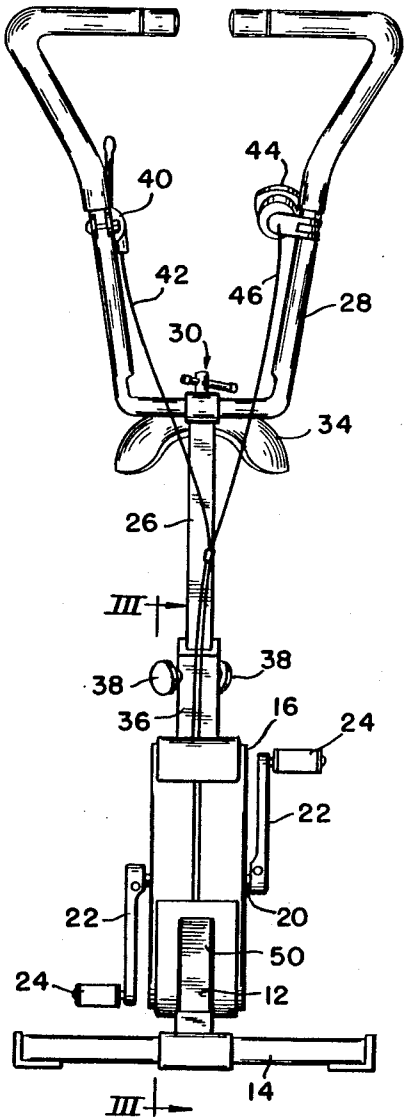
FIG. 2 is a front end elevational view of the cycle illustrated in FIG. 1.

The description herein presented refers to the accompanying drawings in which like reference numerals refer to like parts throughout the several views, and in which, referring to FIG. 1 and FIG. 2, there is illustrated a left side elevational view and a front end elevational view representing the foldable exercise cycle 10 of the present invention in its operational state. Cycle 10 includes legs 12 and stabilizer bars 14 supporting housing 16 which carries foot operated exercising device 18 having drive shaft 20, crank arms 22 and pedals 24. The cycle further includes height adjustable upright 26 supporting handlebar 28 which is rotatably anchored thereto by mounting device 30 (also see FIG. 4) and height adjustable upright 32 supporting seat 34. Conduits 36 supported within housing 16 slidably receive upright members 26 and 32, which members can be secured against movement by rotation of knobs 38 each of which include a threaded portion, not shown, which passes through a respective conduit 36 and engages an upright 26, 32. It should be understood that other suitable fastening devices could be employed for locating the upright members at a selected height. An adjustable breaking device 40 located on handlebar 28 acts through cable 42 to engage the flywheel of FIG. 3 to provide a frictional or braking force resistive to flywheel rotation, thus varying the leg power necessary to move the pedals and drive the flywheel while simultaneously varying the exercise achieved. Coaction of flywheel and braking device is not depicted but such relationship is well known. A speedometer 44, likewise mounted on handlebar 28, acts through cable 46 to measure the speed at which the flywheel is rotating. Handle 48 located in the upper portion of housing 16 provides a convenient gripping area which allows a person to move or carry the cycle from place to place.

Figure 3B:
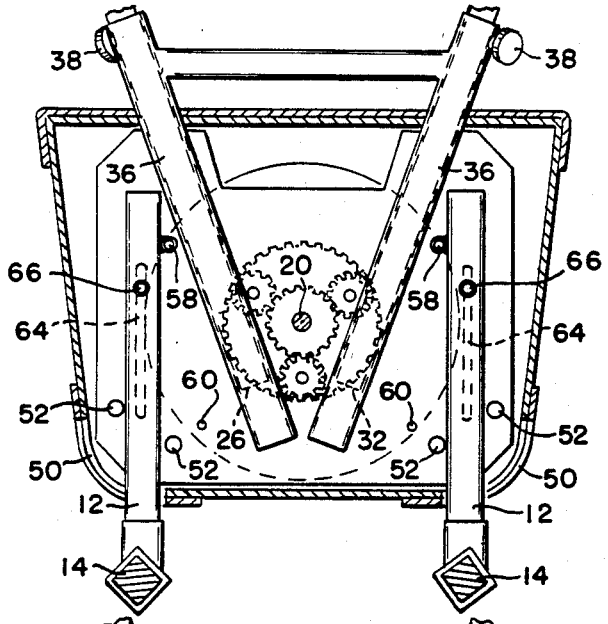
FIG. 3*b* is a view similar to those shown in FIG. 3 and FIG. 3*a* but showing the cycle legs and upright members in a fully folded position.
Figure 3A:
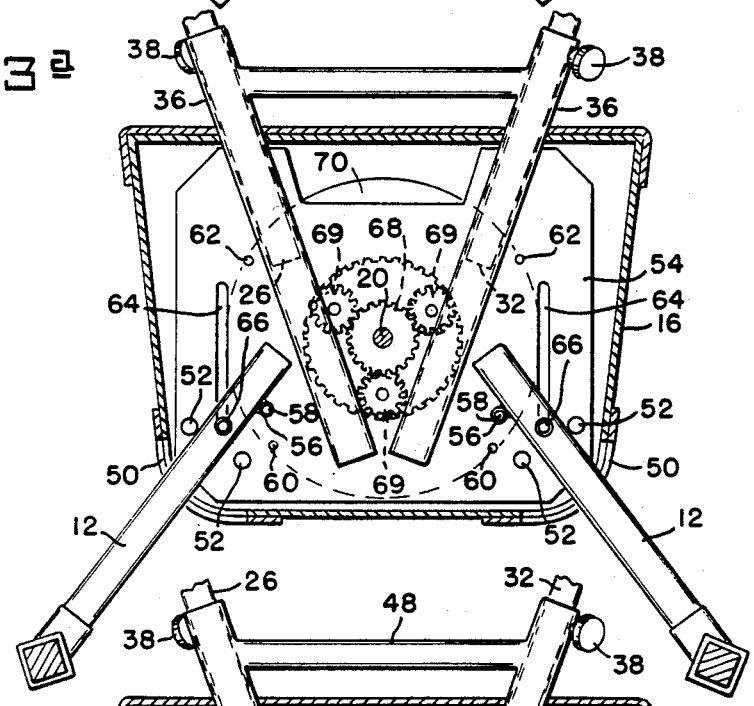
FIG. 3*a* is a view similar to that shown in FIG. 3 but showing the cycle legs and upright members in a partially folded position.
Figure 3:
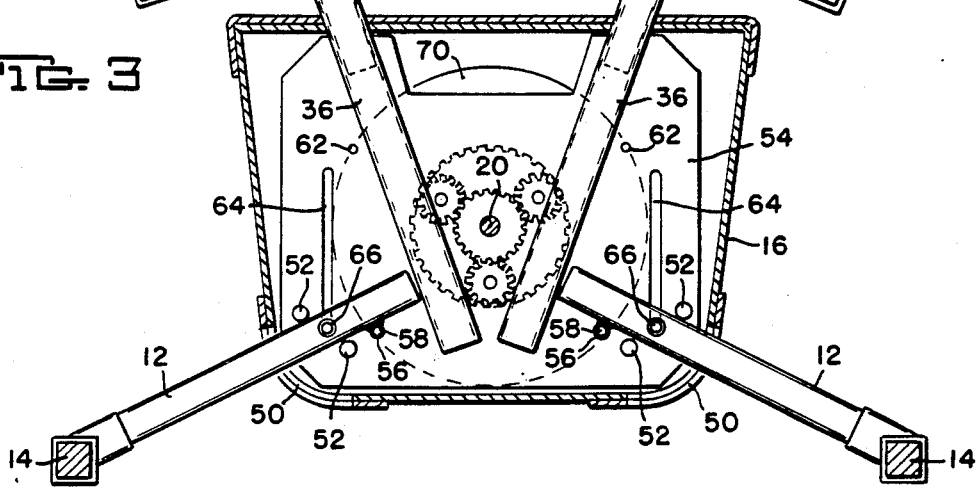
FIG. 3 is a sectional view taken along line 3—3 of FIG. 2.

Turning to FIG. 3, there is shown a sectional view of housing 16 which illustrates housing openings 50 through which legs 12 pass. A pair of bolts 52, or the like, allows for passage of a respective leg 12 therebetween. Plate 54 supports bolts 52 and upright receiving conduits 36 but other support means could be employed. Legs 12 each include a sleeve 56 which assists in retaining the legs within the housing since the combination leg and sleeve width is greater than the opening between a pair of bolts 52 through which each leg passes. It should be understood, however, that a leg 12 need not include a sleeve 56 to be retained in place during either cycle use or storage, for a downward force comprising the weight of the cycle and user could frictionally hold the legs due to the angle at which the legs pass through bolts 52, and the cycle weight alone would retain the fully retracted legs as the cycle is placed in its storage mode. Sleeve 56 might also contain a resilient member 58 located therein and biased in the direction of plate 54 to engage a first plate detent 60 for locking a respective leg in its fully extended position when the cycle is in the operating mode. Similarly, a second plate detent 62 could be employed to lock a leg in its fully retracted position when tne cycle is in the storage mode. The resilient member could be a spring loaded ball bearing or other suitable protruding piece which would serve to releasably secure the leg. Plate 54 could further include elongated slots 64 for receiving dowel pins 66, or the like, each leg 12 having a pin 66 associated therewith engaging a slot for guiding the legs both toward the extended and retracted positions. Also shown in this view are components of the exercising device which includes drive shaft 20, interacting drive gear 68, planetary gears 69 and flywheel 70 (also see FIG. 3*a*). Operational details of the exercise components are not provided but such are known in the art. FIGS. 3 through 3*b* are provided to show progressive movement of cycle legs and upright members as the cycle passes from its fully erect operational position (FIG. 3) to its compact storage position (FIG. 3*b*).

Figure 4:
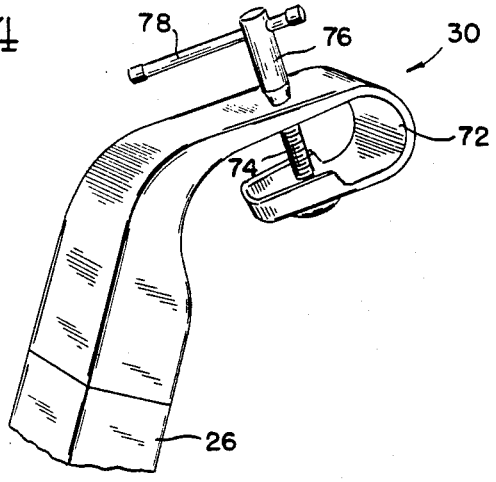
FIG. 4 is an enlarged fragmented perspective view of the handlebar mounting device shown in FIG. 1.

Turning now to FIG. 4, there is shown an enlarged view of handlebar mounting device 30 depicted in lesser detail in FIG. 1. Specifically, mounting device 30 anchored to upright member 26 receives handlebar 28 through opening 72 which can be closed tightly about the handlebar through the interaction of threaded bolt 74 engaging a threaded receiving cap 76 by turning lever arm 78. The grip on the handlebar can be loosened by turning lever arm 78 in the opposite direction. It should be understood that this is but one type of handlebar securing/releasing device which may be employed.

Figure 5:
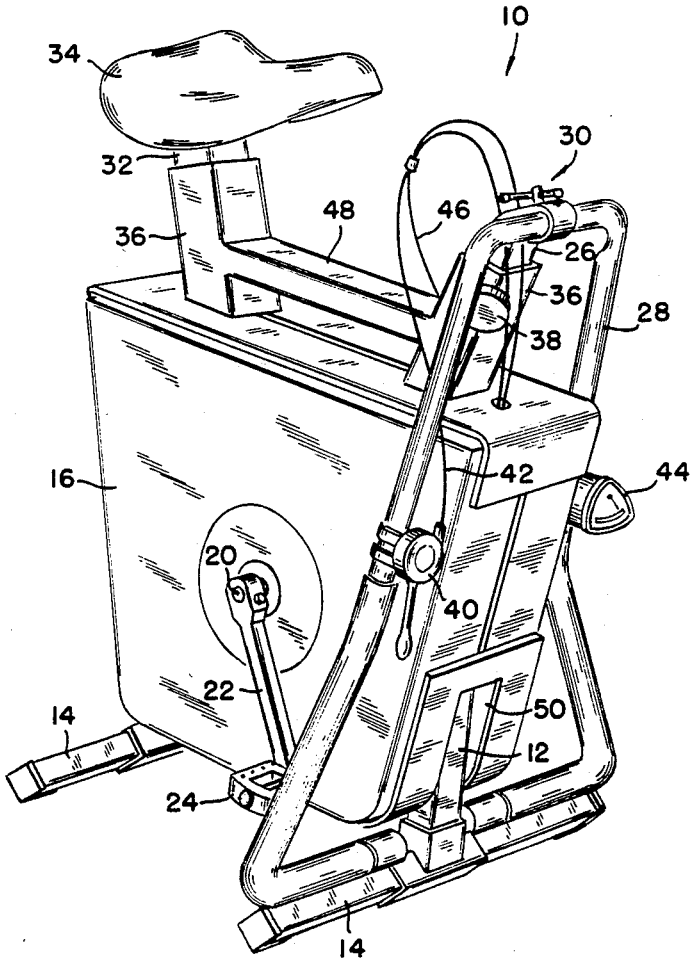
FIG. 5 is an enlarged perspective view of the exercise cycle folded for storage.

FIG. 5 depicts cycle 10 in its folded state, suitable for carrying and storage. To progress from the cycle deployed in its erect, operating position of FIG. 1 to its compact, folded position of FIG. 5, one need only lift the cycle from its ground support, push each leg downwardly and inwardly in the direction of the cycle housing (each leg will pivot and progressively slide into the housing) until substantially all of each leg is located and locked within the housing, loosen the knobs holding each upright member in place and slide both the seat and handlebar support members into the housing, and lastly loosen the handlebar securing device and rotate the handlebar about the housing in either direction. Redeployment of the cycle for use may be accomplished by reversing the folding procedure. It should be understood that one need not follow any particular sequence to achieve an erect or folded cycle position.

While in accordance with the provisions of the statutes there is described herein a specific embodiment of the invention, those skilled in the art will understand that changes may be made in the form of the invention covered by the claims appended hereto without departing from the scope and spirit thereof, and that certain features of the invention may sometimes be used to an advantage without corresponding use of the other features.

The embodiments of the invention in which an exclusive property or privilege is claimed are defined as follows:

1. A foldable exercise cycle comprising a frame having legs supporting a housing, exercising means carried by said housing, a first upwardly directed height adjustable member supporting a handlebar, a second upwardly directed height adjustable member supporting a seat, means for rotatably anchoring said handlebar to said first member, means for receiving a substantial portion of said first and second members within said housing, means for releasably anchoring said first and second members at a selected height, and means for pivotally receiving substantially all of said legs within said housing, said last named means comprising means defining an opening through which an associated leg slidingly pivots as said leg passes therethrough, whereby said cycle may be converted from an erect operating position to a compact storage position by pushing the legs into the housing, by lowering the first and second members, and by rotating the handlebar about the housing.

2. The cycle according to claim 1 wherein said first and second member receiving means is a pair of downwardly convergent conduits supported by said housing, one of said conduits slidably receiving said first member, the other of said conduits slidably receiving said second member.

3. The cycle according to claim 1 wherein each said legs further includes means for retaining a portion of each said legs within said housing when said cycle is positioned for use.

4. The cycle according to claim 3 wherein said retention means is a sleeve projecting from each said legs.

5. The cycle according to claim 4 further including means disposed in said sleeve for engagement with a plate supported within said housing for releasably securing each said leg to said plate.

6. The cycle according to claim 5 wherein said means is a resilient member biased in the direction of said plate for mating engagement with a first detent disposed in said plate to releasably secure a portion of each said legs within said housing when said cycle is positioned for use.

7. The cycle according to claim 6 wherein said plate further includes a second detent for mating engagement with said resilient member to releasably secure each said legs within said housing when said cycle is positioned for storage.

8. The cycle according to claim 7 wherein said plate further includes means for guiding said legs outwardly from said housing when said legs are extended for cycle use and inwardly when said legs are retracted into said housing for cycle storage.

9. The cycle according to claim 8 wherein said guide means includes at least one elongated slot disposed in said plate, each said slot receiving a pin projecting from an operatively associated leg.

10. The cycle according to claim 1 further including a carrying handle disposed in said housing.

11. A foldable exercise bicycle comprising a frame having legs supporting a housing, exercising means carried by said housing, a first upwardly directed height adjustable member supporting a handlebar, a second upwardly directed height adjustable member supporting a seat, means for rotatably anchoring said handlebar to said first member, means for receiving a substantial portion of said first and second members within said housing, means for releasably anchoring said first and second members at a selected height, a plate supported within said housing, said plate including means for pivotally guiding said legs outwardly from said housing when said legs are extended for cycle use and inwardly when said legs are retracted into said housing for cycle storage, whereby said cycle may be converted from an erect operating position to a compact storage position by pushing the legs into the housing, by lowering the first and second members, and by rotating the handlebar about the housing.

12. The cycle according to claim 11 wherein said guide means includes at least one elongated slot disposed in said plate, each said slot receiving a pin projecting from an operatively associated leg.

* * * * *